US008445804B2

(12) United States Patent
Schellekens et al.

(10) Patent No.: US 8,445,804 B2
(45) Date of Patent: May 21, 2013

(54) VACUUM CARTRIDGE FOR AN ELECTRICAL PROTECTION APPARATUS SUCH AS A SWITCH OR A CIRCUIT BREAKER

(75) Inventors: Hans Schellekens, La Terrasse (FR); Serge Olive, Saint Paul de Varces (FR); Olivier Cardoletti, Voiron (FR); Bernard Yvars, Tullins (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 751 days.

(21) Appl. No.: 11/922,046

(22) PCT Filed: Jun. 6, 2006

(86) PCT No.: PCT/FR2006/001274

§ 371 (c)(1),
(2), (4) Date: Dec. 12, 2007

(87) PCT Pub. No.: WO2007/003727

PCT Pub. Date: Jan. 11, 2007

(65) Prior Publication Data

US 2009/0095718 A1 Apr. 16, 2009

(30) Foreign Application Priority Data

Jun. 28, 2005 (FR) ..... 05 06550

(51) Int. Cl.
*H01H 33/66* (2006.01)

(52) U.S. Cl.
USPC ..... 218/139; 218/134; 218/136

(58) Field of Classification Search
USPC ..... 218/10–12, 118, 120, 134–140, 154, 218/155
See application file for complete search history.

(56) References Cited

U.S. PATENT DOCUMENTS 3,903,386 A * 9/1975 Yanagisawa ..... 218/136
4,215,255 A * 7/1980 Kimblin et al. ..... 218/136

FOREIGN PATENT DOCUMENTS

EP 1 005 058 A2 5/2000
GB 1027786 4/1966
JP 53-146179 12/1978

* cited by examiner

*Primary Examiner* — Tulsidas C Patel
*Assistant Examiner* — Marina Fishman
(74) *Attorney, Agent, or Firm* — Steptoe & Johnson LLP

(57) ABSTRACT

A cartridge having at least three shields including a mid-potential shield between two contacts and at least one partial shield between a mid-potential shield and one of the contacts, the distance between the mid-potential shield and the contacts being such that the electric field present at the edge of the contact extends from the contact to the partial shield surrounding it, or vice-versa from the partial shield to the contact, depending on the polarity of the voltage.

13 Claims, 5 Drawing Sheets

VACUUM CARTRIDGE FOR AN ELECTRICAL PROTECTION APPARATUS SUCH AS A SWITCH OR A CIRCUIT BREAKER

The present application is based on International Application PCT/FR2006/001274, filed Jun. 6, 2006, which claims priority to French Patent Application No. 0506550, filed Jun. 28, 2005, the entire contents of which are hereby incorporated by reference.

BACKGROUND OF THE INVENTION

The present invention relates to a vacuum cartridge for an electrical protection apparatus such as a disconnecting switch, a switch or a circuit breaker, said cartridge comprising an enclosure of substantially cylindrical shape closed off by two end-plates, two contacts extending axially inside the enclosure, at least one of these contacts, the movable contact, being connected to an operating mechanism and mounted sliding between a closed position of the contacts enabling flow of the current and a position in which the contacts are separated and withstand the voltage between them, and at least one conducting shield arranged around at least one of the contacts.

In the most commonly used shield design, the contacts are surrounded by a single shield having the function of protecting the insulating parts from metallic projections and of guiding the equipotential lines to prevent dangerous dielectric concentrations. This shield surrounds the two contacts and is situated in the middle of the potential of the two contacts. Thus, in theory, the potential is distributed homogeneously between the two contacts both inside and outside the cartridge.

The distance between the shield and the contacts is chosen such that the interaction between the shield and contacts is smaller than the interaction between the contacts. This enables the electric field between the contacts and shield to be minimized compared with that which is present between the contacts. Risks of flashover between the contact and the shield are thus prevented.

These flashovers between the contacts and shield are extremely dangerous, for when such a flashover occurs, the shield temporarily goes to the potential of the contact (doubling of the potential on the shield) and the distribution of the potential outside is unbalanced with a distribution of 100% of the potential on 50% of the length of the external insulation. This situation can degenerate into an external flashover generating a risk of explosion and fire. The document DE10029763 is also known describing a cartridge designed to withstand higher voltages. These cartridges comprise several ceramics, a shield being designed to be placed at the junction between two successive ceramics to dielectrically protect the triple points and prevent metallization. In this embodiment, the shield surrounds the contacts at an optimal distance corresponding to the distance between the contacts.

The drawback of this type of cartridge lies in the fact that it presents a large diameter. In addition, the higher the application voltage, the larger the distance between the contacts and the length of the ceramics has to be. To avoid flashovers between the contacts and shield, the diameter of the shield also has to be increased.

This increase of the diameter of the shield is however detrimental in terms of cost of the switchgear units and of electrical behaviour.

Indeed, the diameter of the ceramics is proportional to the diameter of the shield, which gives rise to extra cost. Moreover, if an external insulation is provided around the cartridge, the diameter of the outside enclosure also increases with the diameter of the cartridge, which also generates additional cost.

Finally, in the case of use the cartridge in a three-phase switch comprising a shielding, the interaction between the phases for a given distance between the phases is greater the larger the diameter of the cartridges, resulting in a penalizing electrical behaviour.

OBJECT OF THE INVENTION

The present invention solves these problems and proposes a vacuum cartridge of simple design whereby the size of cartridges and therefore the cost thereof can be substantially reduced, and their electrical behaviour be improved.

For this purpose, the object of the present invention is to provide a vacuum cartridge, this cartridge being characterized in that it comprises at least two shields comprising one shield called mid-potential shield inserted between the two contacts and at least one shield called partial shield inserted between said mid-potential shield and one of the contacts, the distance between said mid-potential shield and the contacts being selected such that the electric field present at the edge of the contact goes from the contact to the partial shield (or vice-versa from the partial shield to the contact depending on the polarity of the voltage).

According to a particular embodiment of the invention, said cartridge comprises three shields comprising one mid-potential shield and two partial shields respectively called first and second partial shield, the two partial shields being inserted between the mid-potential shield and respectively the two contacts.

According to a particular feature, said cartridge comprises three shields, and the insulating enclosure comprises four ceramic parts placed end to end, and the three shields are respectively placed at the three junctions between two joining ceramic parts.

According to another feature, the mid-potential shield forms an integral part of the enclosure of the cartridge.

According to another feature, the distance between the mid-potential shield and the contacts expressed in percentage of the distance between the contacts is comprised between 25% and 40%.

Advantageously, the above-mentioned distance is substantially 31%.

According to another feature, the height of the partial shield or shields exceeds the height of the contact or contacts which it surrounds or they surround or, depending on the case, of the partial shield or shields which it surrounds or they surround, by a value comprised between 0 and S/3, S being the distance between the contacts.

According to another feature, the height of the partial shield or of the partial shields exceed(s) the height of the contact or contacts it surrounds or they surround by a value substantially equal to S/4.

Advantageously, at least one of the shields is cylindrical in shape.

According to another embodiment, said cartridge comprises at least one other partial shield, inserted between at least one of the contacts and respectively one of the above-mentioned said partial shields, the distance between the mid-potential shield and the contacts being chosen such that the electric field at the edge of the contacts is directed towards the partial shield(s) directly surrounding the contacts.

According to another particular feature, it comprises two partial shields called first and second partial shield inserted between the mid-potential shield and respectively the two contacts and two other partial shields called third and fourth partial shield respectively inserted between the first and second partial shields and the two contacts.

According to a particular feature, the shields and contacts present a relative capacitance such that the potential difference δU between two shields, one surrounding the other, is substantially identical to that between a contact and the shield surrounding the latter.

Advantageously, this potential difference δU is comprised between 15% and 35% of the total voltage.

Preferably, this potential difference δU is substantially 25% of the total voltage.

According to a particular feature, the cartridge comprising N shields, this potential difference δU does not vary more than 40% with respect to the ratio U total/(N+1), U total being the voltage between the contacts, i.e. with respect to a voltage distributed homogeneously between the contacts.

BRIEF DESCRIPTION OF THE DRAWINGS

But other advantages and features of the invention will become more clearly apparent from the following detailed description which refers to the accompanying drawings given for example purposes only and in which.

DETAILED DESCRIPTION OF AN EMBODIMENT

In FIGS. 1, 3, 4 and 5, a vacuum cartridge A can be seen designed in particular to be integrated in a medium-voltage electric circuit breaker to perform breaking of an electric circuit in the event of a fault or when a deliberate opening action of the electric circuit is performed.

This vacuum cartridge A comprises in a manner known as such a cylindrical enclosure E closed off by two end-plates inside which two arcing contacts are housed, respectively a stationary arcing contact 1 and a movable arcing contact 2. This movable contact 2 is mechanically connected by means of an actuating rod to an operating device (not shown), said rod being connected to said device via one of its ends and being securedly fixed to the movable arcing contact via its opposite end. This operating device is able to move the aforementioned rod and the movable contact in translation inside the enclosure between two positions, respectively a closed position of the contacts corresponding to normal operation of the apparatus and an open position or contact separation position after a fault has occurred in the electric circuit to be protected or when a deliberate opening action of the electric circuit is performed.

Figure 1:
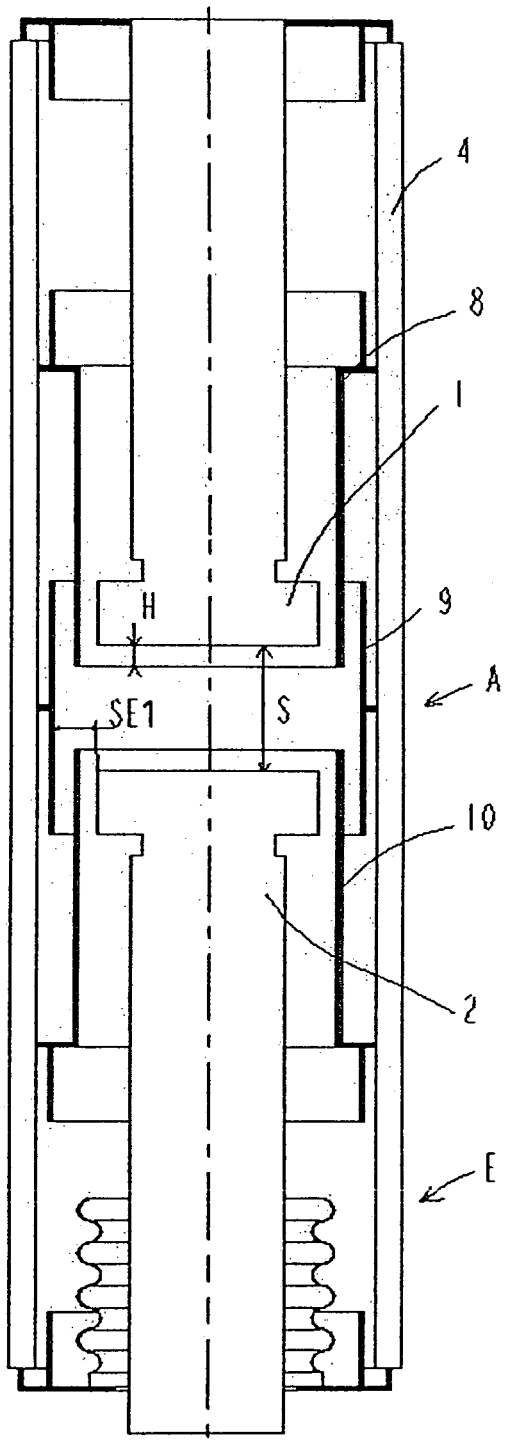
FIG. 1 is an axial cross-sectional view of a vacuum cartridge according to a first embodiment of the invention comprising three shields.

In FIG. 1, this cylindrical enclosure comprises a single ceramic 4 and the cartridge comprises three shields 8,9,10 situated around the contacts 1,2, the shields 8,9,10 all being arranged inside the cartridge. These shields comprise a mid-potential shield 9, or shield called 50% shield, surrounding the two contacts 1,2. If the contacts 1 and 2 respectively have a voltage of 100% and 0%, the potential of the shield is at 50% in the middle of the two potentials of the contacts. These shields also comprise two shields called partial shields 8,10 respectively called a first shield 8 at 75% and a second shield 10 at 25%. According to the invention, these partial shields 8,10 are inserted between the mid-potential shield 9 and the contacts 1,2, said partial shields 8,10 being superposed over a part of their length with the mid-potential shield 9.

Figure 3:
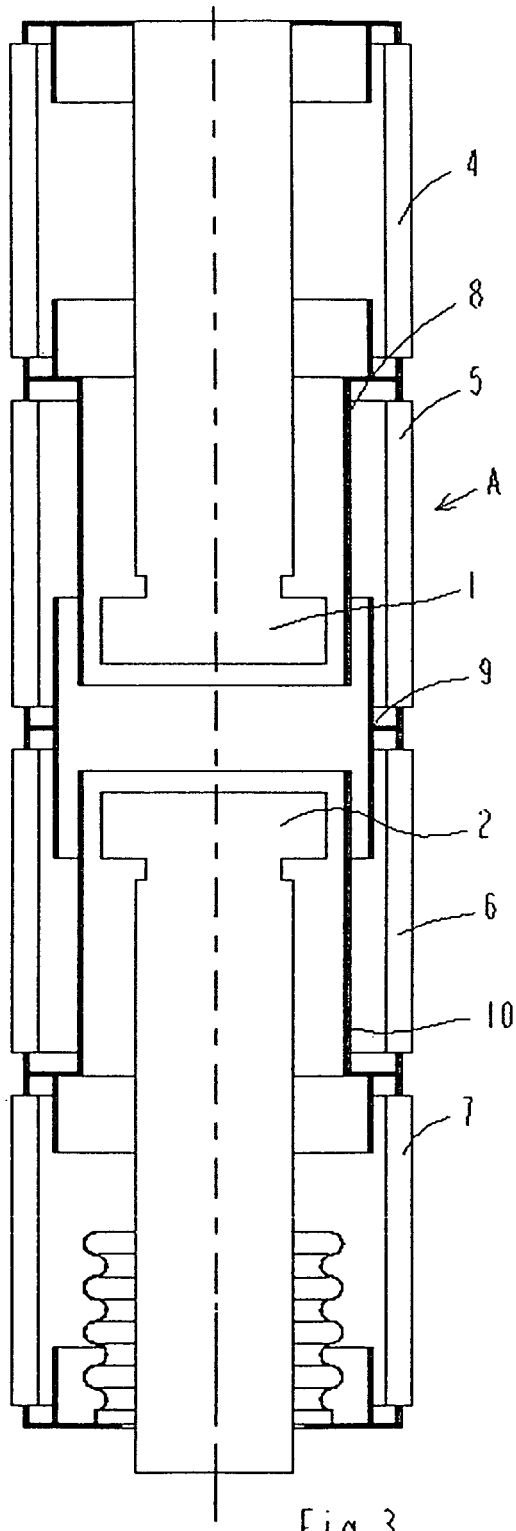
FIG. 3 is an axial cross-sectional view of a vacuum cartridge according to a second embodiment of the invention comprising three shields.

According to the embodiment illustrated in FIG. 3, this cylindrical enclosure E comprises four cylindrical portions of ceramic 4,5,6,7 called the first, second, third and fourth portion, arranged end to end.

The mid-potential shield 9 is fixed between the two central ceramics 5,6, whereas the two partial shields 8,10, respectively the first partial shield 8 and second partial shield 10, are respectively fixed between the first ceramic 4 and the second ceramic 5 for one 8, and between the third and fourth ceramic 6,7, for the other 10. The first partial shield 8 surrounds the stationary contact 1 whereas the second partial shield 10 surrounds the movable contact 2.

According to the invention, the distance between the mid-potential shield 9 and the contacts 1,2 is such that the electric field at the edge of the contacts is directed in the direction of the partial shields 8,10 surrounding said contacts so as to foster a flashover between the contacts and the shields 8,10 rather than between the contacts.

Figure 4:
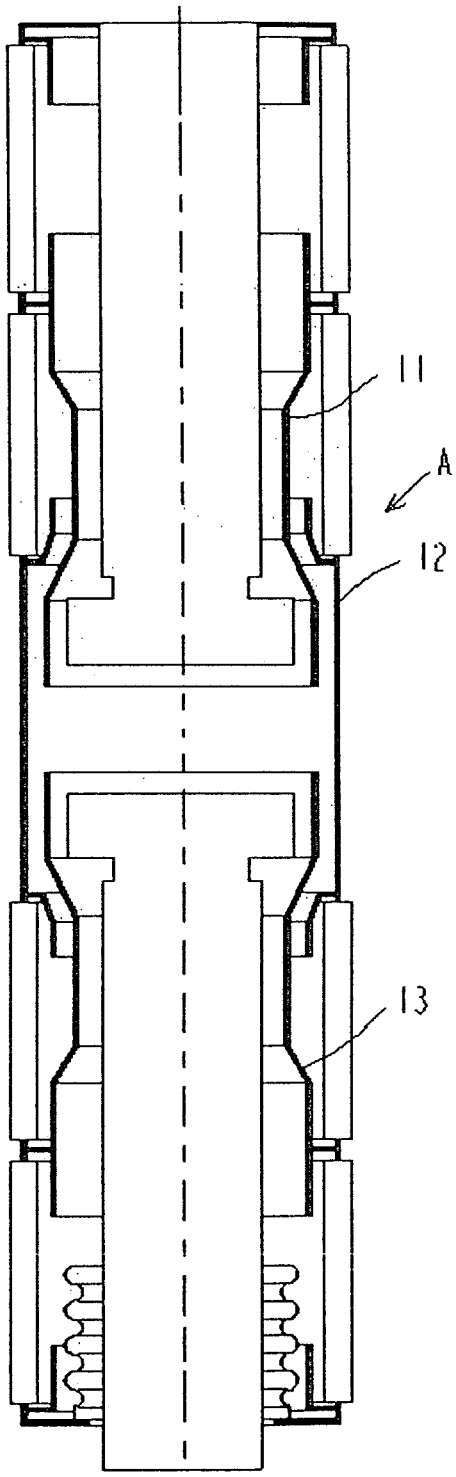
FIG. 4 is an axial cross-sectional view of a vacuum cartridge according to another embodiment of the invention comprising three shields.

In FIG. 4, the cartridge according to another embodiment comprises three shields 11,12,13 and four ceramics 4,5,6,7 the mid-potential shield 12 forming a part of the enclosure of the cartridge.

Figure 5:
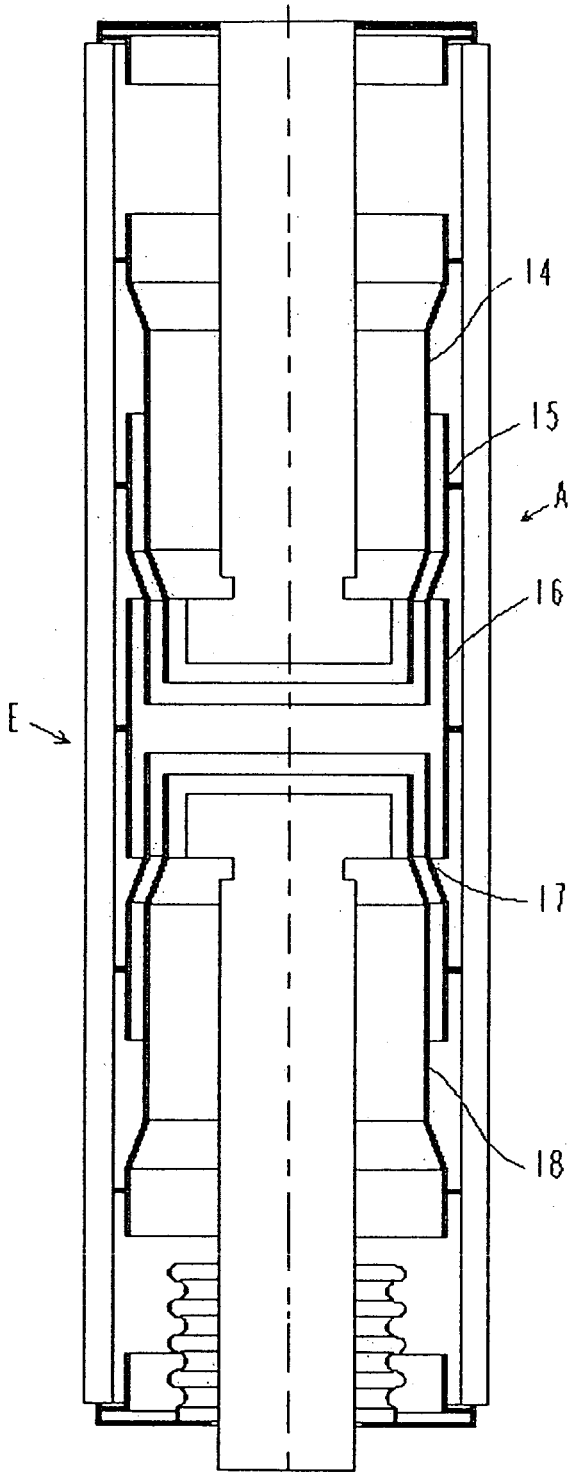
FIG. 5 is an axial cross-sectional view of a vacuum cartridge according to another embodiment of the invention comprising five shields.

In FIG. 5, the cartridge according to another embodiment comprises five shields and a single ceramic.

It can be seen that two partial shields 14,15 and 17,18 are situated between the mid-potential shield 16 and each contact 1,2, the shields 14,18 partially overlapping the shields 15,17.

The table below indicates the distance between the mid-potential shield and the contacts expressed as a function of the contact distance.

S is the distance between the contacts.

| Ratio | Three shields | Five shields | Seven shields |
|---|---|---|---|
| Optimal | 0.31*S | 0.21*S | 0.16*S |
| Minimum | 0.27*S | 0.19*S | 0.14*S |

By fitting a shield between the contact and the mid-potential shield, direct flashovers to the mid-potential shield are prevented. Doubling of the potential on the shield central therefore no longer occurs.

This major risk being avoided, it is then possible to foster an electric field directed from the contact to the shield that is nearest to the contacts and no longer between the contacts. This increases the risk of flashover between the contact at 100% potential and the intercalated shield, but in case of a flashover between this contact having a 100% potential and the intercalated shield having a potential of about 75% for a cartridge with three shields, the intercalated shield reaches a potential of 100% and the mid-potential shield follows this potential change by capacitive coupling and only reaches a potential of 67%.

Thus, according to the invention, the electric field at the end of the contact points towards (or originates from, depending on the polarity of the voltage) the nearest shield surrounding it.

For a shield configuration of more than three shields, the electric field at the end of the shield points towards (or originates from, depending on the polarity of the voltage) the nearest shield surrounding it.

It should also be noted that the shields and contacts have a capacitance between them such that the potential difference ΔU between two shields surrounding one another or between a contact and the shield surrounding it is almost identical. Thus, for a cartridge with three shields, the potential difference ΔU must, to be acceptable, be situated between 15% and 35%, and will advantageously be close to 25% of the total voltage.

Thus, for a cartridge comprising N shields, this potential difference δU does not vary more than 40% with respect to the ratio U total/(N+1), U total being the voltage between the contacts.

For a cartridge with three shields or more, the intercalated partial shields 8,10 exceed the contact they surround by a value H comprised between 0 and S/3, S being the distance between the contacts, and advantageously by a height close to S/4.

Also, the distance SE1 between the mid-potential shield 9 and the contact is, to be acceptable, comprised between 25% and 40% of the distance between the contacts S, and preferably equal to 31%.

The table below indicates these values for the configurations with 3 shields, 5 shields and 7 shields.

δU: voltage difference (expressed in percentage of the total voltage) between two shields surrounding one another or between a contact and the shield that surrounds the latter.

H: excess height of the shields; either with respect to the contact or for two shields surrounding one another.

SE1: distance between the contacts and the mid-potential shield.

| | 3 shields | 5 shields | 7 shields |
|---|---|---|---|
| δU - preferential | 25% | 16.7% | 12.5% |
| Range of δU | 15% < δU < 35% | 10% < δU < 25% | 8% < δU < 20% |
| H - preferential | 0.25 * S | 0.167 * S | 0.125 * S |
| Range of H | 0 < H < 0.3*S | 0 < H < 0.2*S | 0 < H < 0.15*S |
| SE-1 - preferential | 0.31*S | 0.21*S | 0.16*S |
| Range of SE-1 | 0.27*S < SE-1 < 0.4*S | 0.19*S < SE-1 < 0.3*S | 0.14*S < SE-1 < 0.2*S |

Although this solution is more constraining than the one according to the prior art tending to eliminate risks of flashover, the risks incurred in case of flashover are considerably reduced in the case of the invention as compared with the prior art.

The two following limit cases according to the prior art with a single 50% shield can in fact be discerned.

At the maximum distance of the mid-potential shield with respect to the contacts, the maximum electric field at the edge of the contacts is not influenced by the presence of the shield. This electric field therefore has the value E1. This situation is indeed similar to a situation in which no 50% shield is provided. The field E1 is therefore the weakest field that can exist between the two contacts in a cartridge with a single shield. If the shield is moved closer to the two contacts, the electric field will be influenced by this movement towards one another and will start to increase. At the beginning of this movement towards one another, the electric field at the edge of the contact face is still pointing towards the other contact. Let SE be the distance between the contact and the 50% shield, a distance called the switching distance, SE switching, can be found which marks a transition in the direction of the electric field such that for SE>SE (switching), the electric field points in the direction of the other contact and that for SE<SE (switching) the electric field points in the direction of the 50% shield.

Thus, the minimum distance is equal to SE (switching) so as to prevent an interaction with the shield.

At this minimum distance of the shield with respect to the contacts at which the electric field is still just pointing towards the contacts and is not yet pointing towards the shield, the electric field at the edge of the contacts reaches the value E2, the value E2 being higher than the value E1 mentioned above.

Thus according to the invention, this increased risk of flashover between the contacts and the intercalated shield will be accepted without however exceeding the commonly accepted electric field values E1 and E2. The electric field therefore remains comprised between E1 and E2.

Figure 2:
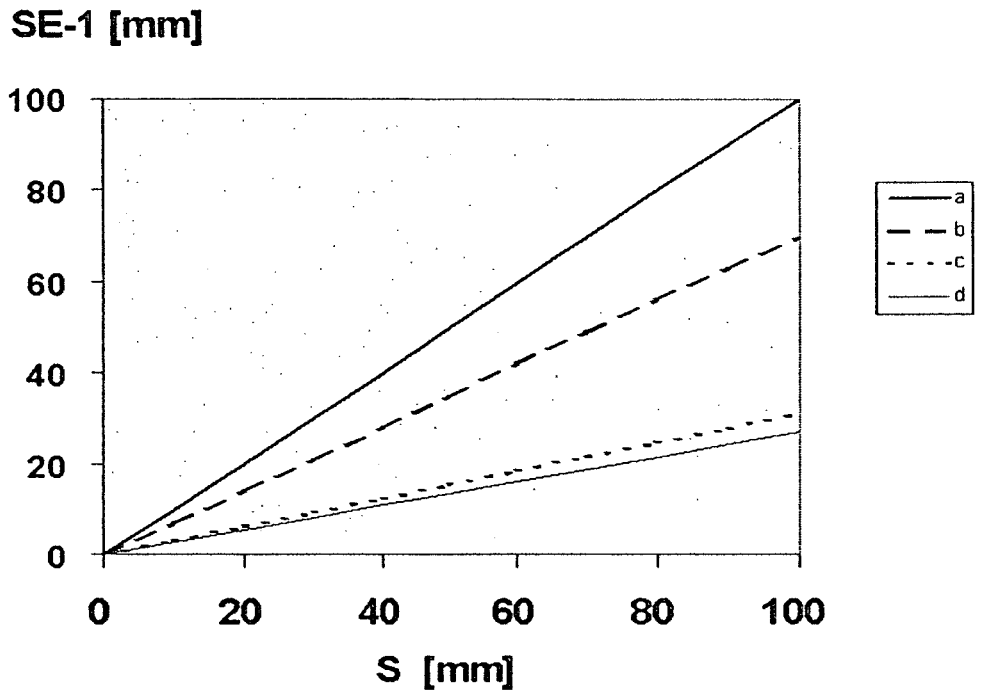
FIG. 2 is a graphic representation representing the distance between the mid-potential shield and the contacts versus the distance between the contacts.

FIG. 2 represents the distance between the contacts and the central shield as a function of the distance between the contacts.

Curve a represents the distance between the contacts and the shield, recommended by the prior art notably in the Patent DE 10029763. Curve b represents the minimum distance enabling an interaction between the contacts and the shield to be prevented according to the prior art.

Curve c represents the distance between the contacts and the shield, in a configuration with three shields according to the invention, which gives an electric field at the edge of the contacts that is identical to the case of curve a, and curve d represents the distance between the contacts and the shield which gives an electric field at the edge of the contacts that is identical to that of curve b.

It can be seen in FIG. 2 that, according to the prior art, the distance between the mid-potential shield and the contacts is situated between curves a and b, whereas according to the invention, this distance is situated between curves c and d.

It can be seen that a gain of 50 to 70% can be obtained on the distance between the shield and the contacts for a cartridge comprising three shields.

An additional gain can be obtained with a cartridge according to the invention comprising five shields or seven shields as represented in FIGS. 4 and 5, as indicated in the table. For a cartridge with five shields, the distance between the shield and the contacts is in fact comprised between 0.19*S and 0.21*S, S being the distance between the contacts. An even greater gain can be obtained with a cartridge according to the invention comprising seven shields, for which the distance between the shield and the contacts is comprised between 0.14*S and 0.16*S.

A vacuum cartridge of simple design presenting a considerably reduced radial diameter has therefore been achieved by means of the invention.

This enables the cost of the cartridges and that of circuit breakers or cubicles to be reduced by the use of reduced-diameter ceramics and reduced-diameter enclosures.

This also enables the electrical interaction between the phases in metalclad equipment units to be reduced. A better behaviour is thus obtained when operating voltage surges are encountered.

The invention is naturally not limited to the embodiments given for example purposes only. The invention therefore covers any embodiment of a cartridge comprising an odd number of shields, the shields at nearest potential to that of the contacts being placed in such a way as to hide the mid-potential shield or the other partial shields over a certain length, in the case where the cartridge comprises more than three shields, with respect to this contact, the electric field at the edge of the contact pointing towards (or originating from, depending on the polarity of the voltage) the nearest shield that surrounds it, and the electric field at the end of the partial shield (other than the mid-potential shield) pointing towards (or originating from, depending on the polarity of the voltage) the nearest partial shield that surrounds it.

On the contrary, the invention encompasses all the technical equivalents of the means described and combinations thereof if the latter are performed according to the spirit of the invention.

The invention claimed is:

1. A vacuum cartridge for an electrical protection apparatus, said cartridge comprising an enclosure of substantially cylindrical shape closed by two end-plates, two contacts extending axially inside the enclosure, at least one of these contacts being movable and connected to an operating mechanism, and mounted for sliding between a closed position in which flow of current is enabled, and a position in which the contacts are separated and withstand voltage between them, and at least one conducting shield around at least one of the contacts, said at least one conducting shield comprising a mid-potential shield, a first partial shield, and a second partial shield, said mid-potential shield being radially between the two contacts and the enclosure, and each of the two partial shields being radially between said mid-potential shield and one of the two contacts, said shields being fixed at a point of the enclosure without any electrical connection with either of the contacts, wherein the distance between said mid-potential shield and each of the contacts is between 25% and 40% of the axial distance between the contacts, in order to cause an electric field present at the edge of each contact to extend to one of the partial shields or from a partial shield to one of the contacts depending on the polarity of the voltage.

2. The vacuum cartridge according to claim 1, comprising three shields, the insulating enclosure comprising four ceramic parts placed end to end, and the three shields being respectively placed at the three junctions between two joining ceramic parts.

3. The vacuum cartridge according to claim 1, wherein the mid-potential shield forms an integral part of the enclosure of the cartridge.

4. The vacuum cartridge according to claim 1, wherein said distance between the mid-potential shield and the contact is substantially 31%.

5. The vacuum cartridge according to claim 1, wherein the height of the partial shield or shields exceeds the height of the contact or contacts which it surrounds or they surround or of the partial shield(s) which it surrounds or they surround, by a value between 0 and S/3, excluding 0, S being the distance between the contacts.

6. The vacuum cartridge according to claim 5, wherein the height of the partial shield or shields exceeds the height of the contact or contacts which it surrounds or they surround by a value substantially equal to S/4.

7. The vacuum cartridge according to claim 1, wherein at least one of the shields is cylindrical in shape.

8. The vacuum cartridge according to claim 1, comprising at least one other partial shield between one of the contacts and one of said partial shields, the distance between the mid-potential shield and the contacts being such that an electric field at the edge of the contacts extends towards the partial shield or shields directly surrounding the contacts.

9. The vacuum cartridge according to claim 1, comprising a first and a second partial shield between the mid-potential shield and the two contacts and third and fourth partial shields between the first and second partial shields and the two contacts.

10. The vacuum cartridge according to claim 1, wherein the shields and contacts present a relative capacitance such that the potential difference $\delta U$ between two shields, one surrounding the other, is substantially identical to that between a contact and the shield surrounding it.

11. The vacuum cartridge according to claim 1, wherein the shields and contacts have a relative capacitance such that the potential difference $\delta U$ between two shields, one surrounding the other, is substantially identical to that between a contact and the shield surrounding it, this potential difference $\delta U$ being between 15% and 35% of the total voltage.

12. The vacuum cartridge according to claim 1, wherein the shields and contacts have a relative capacitance such that the potential difference $\delta U$ between two shields, one surrounding the other, is substantially identical to that between a contact and the shield surrounding it, this potential difference $\delta U$ being substantially 25% of the total voltage.

13. The vacuum cartridge according to claim 10 comprising N shields, characterized in that this potential difference $\delta U$ does not vary more than 40% with respect to the ratio U total/(N+1), U total being the voltage between the contacts.

* * * * *